US009895924B2

(12) United States Patent
Medhin

(10) Patent No.: US 9,895,924 B2
(45) Date of Patent: Feb. 20, 2018

(54) ARTICULATED PEN

(71) Applicant: Michael S. Medhin, Alexandria, VA (US)

(72) Inventor: Michael S. Medhin, Alexandria, VA (US)

( * ) Notice: Subject to any disclaimer, the term of this patent is extended or adjusted under 35 U.S.C. 154(b) by 0 days.

(21) Appl. No.: 15/162,842

(22) Filed: May 24, 2016

(65) Prior Publication Data

US 2017/0341456 A1 Nov. 30, 2017

(51) Int. Cl.

| | |
|---|---|
| ***B43K 5/00*** | (2006.01) |
| ***B43K 23/12*** | (2006.01) |
| ***B43K 24/02*** | (2006.01) |
| ***B43K 7/00*** | (2006.01) |

(52) U.S. Cl.

CPC ..... *B43K 5/005* (2013.01); *B43K 7/005* (2013.01); *B43K 23/12* (2013.01); *B43K 24/02* (2013.01)

(58) Field of Classification Search

CPC ..... B43K 5/005; B43K 7/005; B43K 8/003
See application file for complete search history.

(56) References Cited

U.S. PATENT DOCUMENTS

| | | | | |
|---|---|---|---|---|
| 3,352,621 | A | 11/1967 | Fehling et al. | |
| 3,554,660 | A * | 1/1971 | Woods | B43K 7/00 401/214 |
| 4,679,954 | A | 7/1987 | Ambasz | |
| 4,906,119 | A * | 3/1990 | Hartford | B43K 7/005 401/48 |
| D311,211 | S | 10/1990 | Dot | |
| 5,012,663 | A | 5/1991 | Brown | |
| 5,172,994 | A | 11/1992 | Brown | |
| D345,579 | S | 3/1994 | Yanez, Jr. | |
| 5,527,124 | A | 6/1996 | Kolaric | |
| 5,564,849 | A | 10/1996 | Greer, Jr. | |
| 5,988,921 | A | 11/1999 | Medhin | |
| 7,195,415 | B1 * | 3/2007 | Vial | B43K 5/005 401/109 |
| 2005/0152736 | A1 * | 7/2005 | Liu | B43K 5/005 401/6 |
| 2008/0205964 | A1 * | 8/2008 | Liu | B43K 5/005 401/6 |

(Continued)

FOREIGN PATENT DOCUMENTS

| | | |
|---|---|---|
| DE | 9000724 | 4/1990 |
| FR | 1253384 | 2/1961 |

(Continued)

*Primary Examiner* — Jennifer C Chiang
*Assistant Examiner* — Bradley Oliver
(74) *Attorney, Agent, or Firm* — Andrew M. Calderon; Roberts Mlotkowski Safran Cole & Calderon, P.C.

(57) ABSTRACT

Articulated pens are provided. A pen includes: a shank; an ink tube comprising a first section, a second section, a third section, and a fourth section; a writing tip connected to the fourth section; a first guide rail connected to the shank and that bends the ink tube at a first angle between the first section and the second section; and a second guide rail pivotally connected to the first guide rail and that bends the ink tube at a second angle between the third section and the fourth section. Pivoting the second guide rail relative to the first guide rail adjusts a third angle between the second section and the third section.

12 Claims, 14 Drawing Sheets

(56) References Cited

U.S. PATENT DOCUMENTS

| | | | | |
|---|---|---|---|---|
| 2012/0055278 | A1* | 3/2012 | Hasty | B43K 7/005<br>74/89.45 |
| 2014/0064820 | A1* | 3/2014 | Mach | B43K 7/03<br>401/52 |

FOREIGN PATENT DOCUMENTS

| | | |
|---|---|---|
| GB | 222374 | 10/1924 |
| WO | 91/16210 | 10/1991 |

* cited by examiner

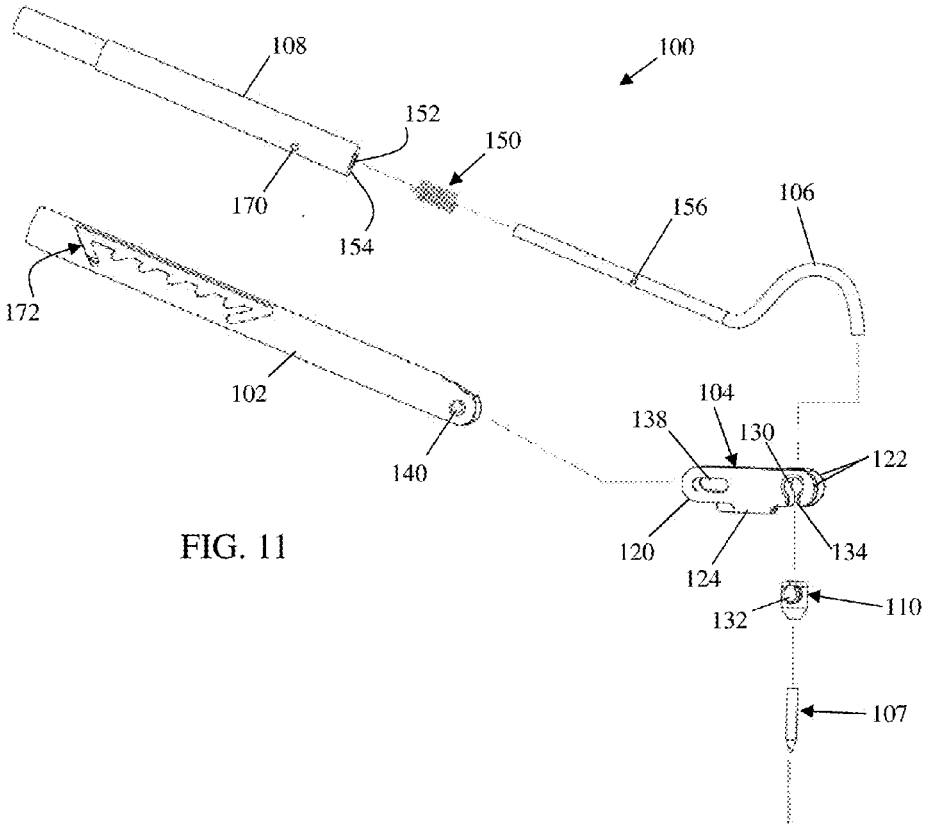
FIG. 11
FIG. 12
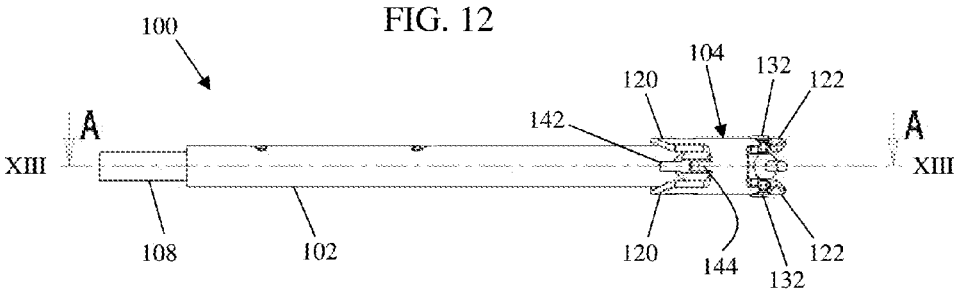
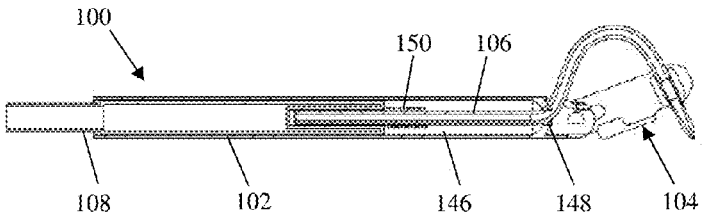
FIG. 13

ARTICULATED PEN

FIELD OF THE INVENTION

The invention generally relates to the field of writing utensils and, more particularly, to articulated pens for alleviating poor posture during writing.

BACKGROUND

Many written languages, such as English, are read from left to right and written in the same direction. To write in such a language, a person holding a pen in their right hand (e.g., a right hander) drags the pen from left-to-right across a writing surface (e.g., a piece of paper). In contrast, a person writing with a pen in their left hand (e.g., a left hander) pushes the pen from left-to-right across the writing surface. The natural position of the pen in the left hand causes the pen to be inclined into the paper in the direction of writing and consequently aligns the pressure being exerted by the left hand against the paper with the direction of movement. This contrasts with a right-hander whose writing pressure is directed opposite the direction of movement across the page. These facts thus present a number of problems for a person holding a pen in their left hand while writing from left to right.

Similar problems may exist for a person holding a pen in their right hand while writing from right to left. There are a number of languages that are written in the right to left direction, including: Arabic script, Hebrew alphabet, Syriac alphabet, Samaritan alphabet, Mandaic alphabet, Thaana, Mende Kikakui, N'Ko script, and Adlam. A right handed person holding a pen in their right hand and pushing the pen from right to left across a written page will experience the same problems as a left handed person holding a pen in their left hand and pushing the pen from left to right across the written page.

For example, as a pen is pushed by a left hand in a left-to-right writing direction, the left hand may be dragged across the face of the newly inked paper, causing it to smear. This is a function solely of the left-to-right direction of travel of the pen relative to the page. Moreover, the inclination of the pen against the paper, i.e., the left hand pushing the pen into the paper while holding the pen in the natural position, causes the tip of the pen to be jammed into the paper, which may cause the paper to rip. To avoid these problems, a left hander often compensates by repositioning one or more of their torso, arm, wrist, and fingers relative to place the pen at a desired angle relative to the writing surface. This physical repositioning comes at a cost to the writer, however, in the form of aches, pain, poor posture, and even carpal tunnel syndrome in prolonged cases.

Pens specifically designed for left handed writers are known in the art. For example, U.S. Pat. No. 5,988,921 issued to the same inventor, discloses an embodiment in which only the tip of a pen is angled. It has been found that this arrangement creates a pivot point and places the pen out of alignment with the central axis that is naturally present in writing instruments, making the pen somewhat uncomfortable and difficult to use.

SUMMARY

An object of the invention is to empower writers with the best most mechanically sound writing position possible while maintaining an ergonomic hand and body position. Attempting to drag the tip of the writing point across (instead of pushing it into) the writing surface is the main reason why left handers contort their body, arm, and wrist when using conventional pens. In contract to conventional pens, pens in accordance with aspects of the invention help left handers avoid having to contort their wrist, arm and body to find a drag position of the point. In embodiments, the writing point of the pen is coincident with a center line of symmetry of the handle, shank, or hand held part of the pen. Keeping the symmetry of the body and the pen prevents creating an off-center pivot point that makes it difficult or uncomfortable for the writer to maintain balance of the writing utensil. In embodiments, when the inventive pen is held in a user's left hand, a center line of the conical tip of the pen is at an angle between 90 and 45 degrees with the writing surface leaning to the right of a vertical plane, while having the writing tip of the pen on the same symmetrical line as the handle of the pen. Conversely, when the inventive pen is held in a user's right hand, a center line of the conical tip of the pen is at an angle between 90 and 45 degrees with the writing surface leaning to the left of a vertical plane, while having the writing tip of the pen on the same symmetrical line as the handle of the pen. To accomplish this arrangement, the conical tip of the pen forms an angle in the opposite direction of the shank.

Another object of the invention is to provide a pen that accommodates different hand sizes while still permitting the user to achieve the desired angle of the pen relative to the writing surface without having to contort their wrist/arm/body. Specifically, pens that have a static angle of tip to shank (or handle), do not readily accommodate different hand sizes of different users. While such a static pen might work well for some users, the same pen may be essential useless to another user with a different hand size. Accordingly, in embodiments, the pen is articulated in a manner that provides for dynamically setting different angles between the tip of the pen and the shank (or handle) of the pen.

In an aspect of the invention, there is a pen including: a shank; an ink tube comprising a first section, a second section, a third section, and a fourth section; a writing tip connected to the fourth section; a first guide rail connected to the shank and that bends the ink tube at a first angle between the first section and the second section; and a second guide rail pivotally connected to the first guide rail and that bends the ink tube at a second angle between the third section and the fourth section. Pivoting the second guide rail relative to the first guide rail adjusts a third angle between the second section and the third section.

In another aspect of the invention, there is a pen including: a shank; a push element slidably connected to the shank; a chassis pivotally connected to the shank; a gimbal pivotally connected to the chassis; and an ink tube having a first end connected to the push element and a second end connected to a writing tip. At least one of the ink tube and the writing tip passes through the gimbal.

In another aspect of the invention, there is a pen including: a shank; a push element slidably connected to the shank; and an ink tube having a first end connected to the push element and a second end connected to a writing tip. At least one of the ink tube and the writing tip passes through a pivotable gimbal. The ink tube is bent at a location that is both between the first end and the second end and outside the shank.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

FIGS. 9-18 and 19A-H show another pen in accordance with aspects of the invention.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention generally relates to the field of writing utensils and, more particularly, to articulated pens for alleviating poor posture during writing. According to aspects of the invention, a pen has an articulated portion that permits a user to selectively set at an angle of the writing tip of the pen relative to the shank of the pen. In an embodiment, a pen includes a spring-biased push-button mechanism that moves the articulated portion to set the angle of the tip relative to the shank. In another embodiment, a pen includes an ink tube that is fixedly bent at an elbow portion near the writing tip. The elbow portion, including the writing tip, may be selectively set at an angle relative to the remainder of the ink tube and the shank. In this manner, implementations of the invention provide articulated pens that may be used to adjust the angle of the writing tip of the pen relative to the writing surface, such that a left handed person may use the pens in a dragging (instead of pushing) motion when writing from left to right across a page, and such that a right handed person may use the pens in a dragging motion when writing from right to left across a page.

Figure 1:
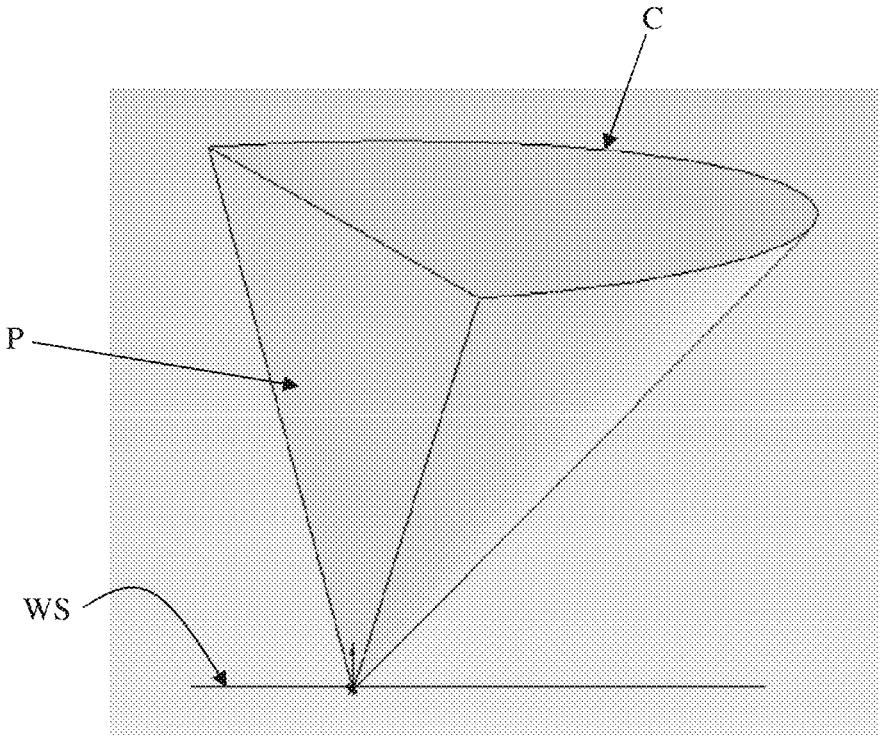
FIG. 1 shows a volume of preferred angles in accordance with aspects of the invention.

FIG. 1 shows half of a cone "C" that is on the right side of the page or in the direction of the written word and the point at the bottom is where the point of a writing utensil will come in contact the writing surface "WS". To avoid the noted problems associated with pushing the writing tip of the pen into the page when holding the pen in the left hand and writing from left to right, the best writing position results when the writing tip of the pen is in the range of angles formed on the right side of a plane "P" that bisects the cone and is perpendicular to the writing surface. The opposite half-cone (not shown) is optimal when holding the pen in the right hand and writing from right to left. It is within this range of angles defined by the bisected cone that will result in the writing tip of the pen being dragged across the writing surface, rather than being pushed into the writing surface.

Figure 2:
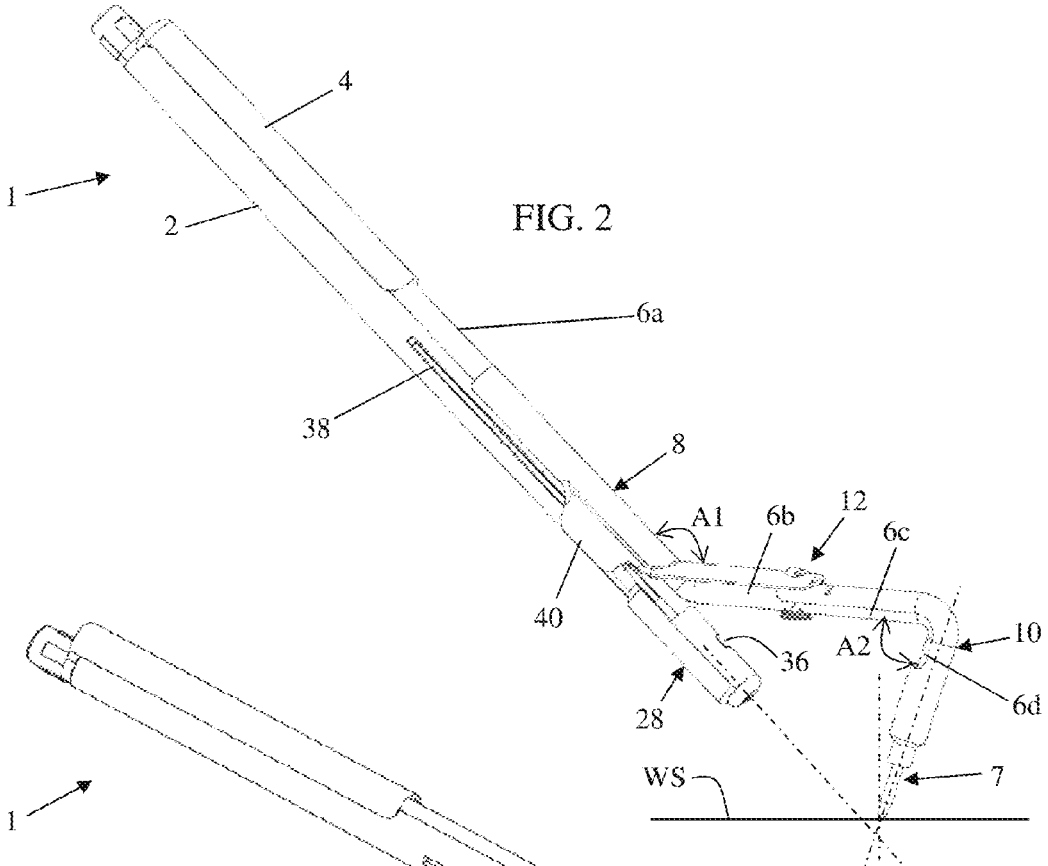
FIGS. 2-6, 7A-G, and 8A-G show a pen in accordance with aspects of the invention.

FIG. 2 shows a first pen 1 in accordance with aspects of the invention. The pen 1 includes a shank 2, a cover 4, an ink tube 6, and a writing tip 7. The ink tube 6 is a tubular member with an internal cavity that is used to store ink for delivering to the writing tip 7. In embodiments, the ink tube 6 includes four sections 6*a*, 6*b*, 6*c*, 6*d*. The first section 6*a* is angled relative to the second section 6*b* by angle A1. A first guide rail 8 maintains the angle A1 between the sections 6*a* and 6*b* in a substantially fixed position, such that section 6*a* does not move relative to section 6*b* to any appreciable extent. In embodiments, the angle A1 is in a range of 135 to 157.5 degrees, although variations of this angle may be used within the scope of the invention. As is evident from FIG. 2, a longitudinal axis of the first section 6*a* is essentially parallel to a longitudinal axis of the shank 2 of the pen 1. Moreover, the longitudinal axis of the first section 6*a*, the longitudinal axis of the second section 6*b*, and the longitudinal axis of the shank 2 all lie in a first plane. At least one of the sections 6*a* and 6*b* may be connected to the second guide rail 10.

Still referring to FIG. 2, the third section 6*c* is angled relative to the fourth section 6*d* by angle A2. A second guide rail 10 maintains the angle A2 between the sections 6*c* and 6*d* in a substantially fixed position, such that section 6*c* does not move relative to section 6*d* to any appreciable extent. In embodiments, the angle A2 is in a range of 45 to 90 degrees with the preferred angle being dependent on A1 and the tip of the pen intersecting the access of the shank, although variations of this angle may be used within the scope of the invention. As is evident from FIG. 2, a longitudinal axis of the third section 6*c* and a longitudinal axis of the fourth section 6*d* lie in a second plane. At least one of the sections 6*c* and 6*d* may be connected to the second guide rail 10.

Figure 3:
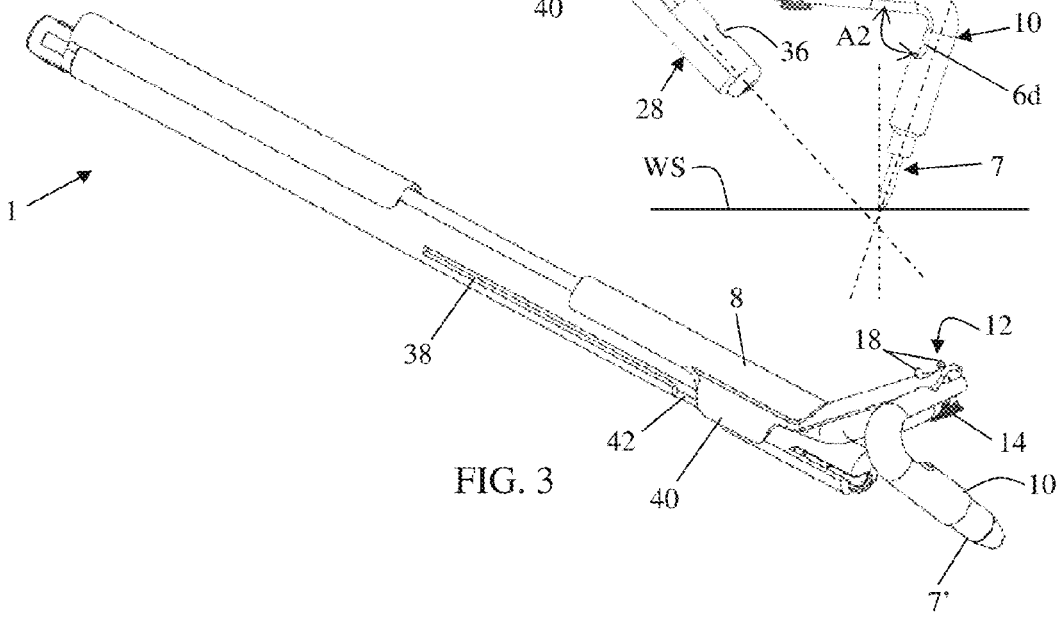

According to aspects of the invention, the first guide rail 8 and the second guide rail 10 are pivotally connected to one another at a joint 12. As shown in FIGS. 2 and 3, the joint 12 permits the second guide rail 10 to rotate relative to the first guide rail 8 about an axis defined by the joint 12. For example, FIG. 2 shows the second guide rail 10 in a first position relative to the first guide rail 8, and FIG. 3 shows the second guide rail 10 in a second position relative to the first guide rail 8. In the first position shown in FIG. 2, the first plane (containing the longitudinal axis of the first section 6*a*, the longitudinal axis of the second section 6*b*, and the longitudinal axis of the shank 2) is coplanar with the second plane (containing the longitudinal axis of the third section 6*c* and the longitudinal axis of the fourth section 6*d*). In the second position shown in FIG. 3, the first plane (containing the longitudinal axis of the first section 6*a*, the longitudinal axis of the second section 6*b*, and the longitudinal axis of the shank 2) is not coplanar with the second plane (containing the longitudinal axis of the third section 6*c* and the longitudinal axis of the fourth section 6*d*). In a preferred embodiment, the joint 12 is structured and arranged to permit about 90° rotation between the first guide rail 8 and the second guide rail 10.

Figure 4:
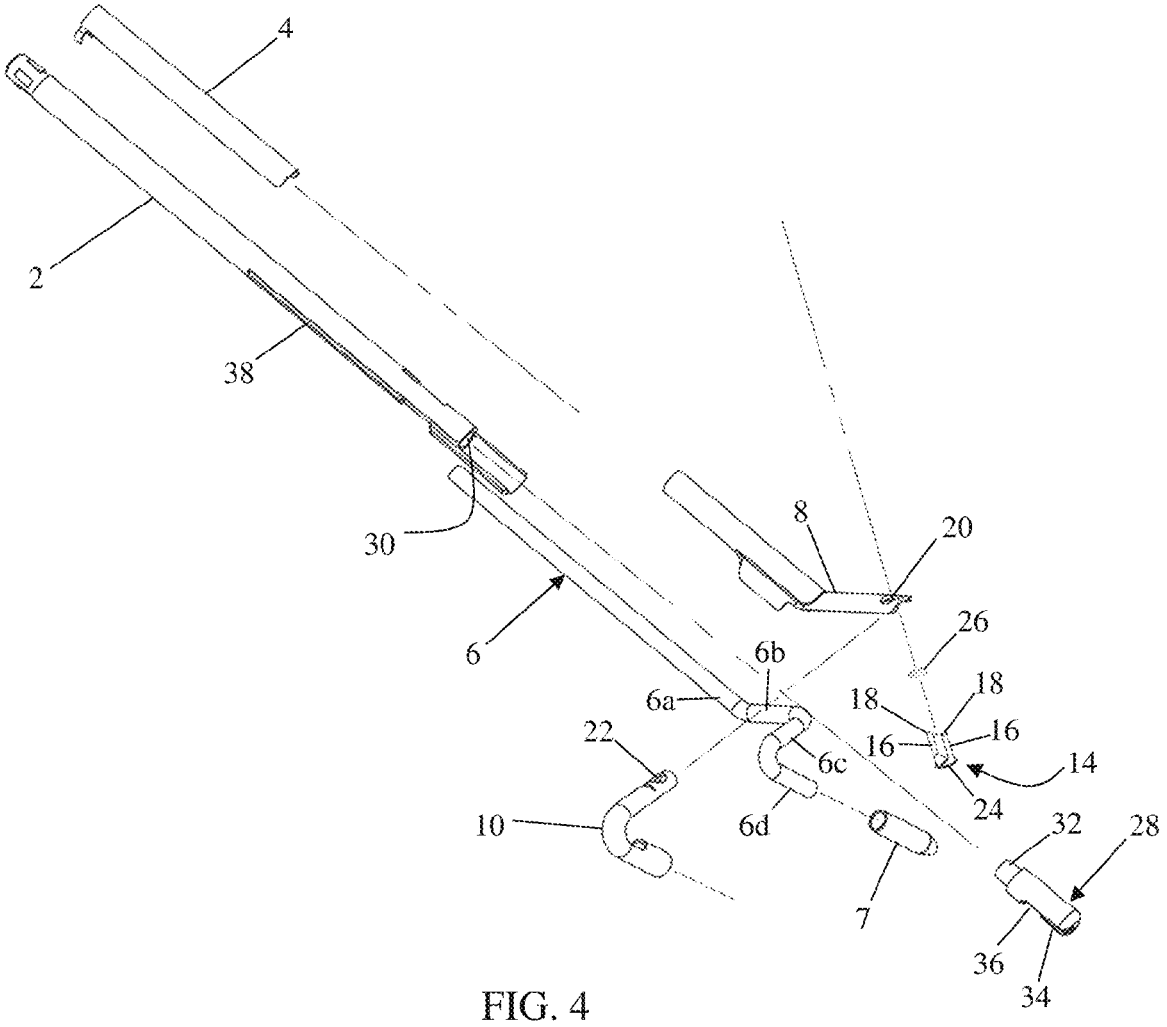

In embodiments, the joint 12 includes a snap ring 14 having flexible arms 16 with locking pawls 18, as illustrated in the exploded view of FIG. 4. In the assembled configuration (e.g., as shown in FIGS. 2 and 3), a first hole 20 in the first guide rail 8 and a second hole 22 in the second guide rail 10 are aligned with one another, the ink tube 6 is positioned between the arms 16, and the arms 16 extend through the holes 20, 22 such that the locking pawls 18 engage the outer surface of the first guide rail 8. In this manner, the ink tube 6 is held between the arms 16 in a first direction, and between the second guide rail 10 and a base 24 of the snap ring 14 in a second direction. The snap ring 14 is configured to rotate with the second guide rail 10 relative to the first guide rail 8 when the locking pawls 18 engage the outer surface of the first guide rail 8 in the assembled state. The structural arrangement provided by the snap ring 14 inhibits kinking of the ink tube 6 when the second guide rail 10 is rotated relative to the first guide rail 8. In embodiments, a spring 26 is arranged between the base 24 and the ink tube 6 to provide a spring bias forces that urges the base 24 away from the ink tube 6, and that also urges the locking pawls 18 into constant contact with the outer surface of the first guide rail 8.

Still referring to FIGS. 2-4, the writing tip 7 is connected to an end of the ink tube 6. The writing tip 7 may be any suitable type of writing tip, including but not limited to a ball point tip, felt tip, etc. For example, FIG. 2 shows a first writing tip 7 having a first shape and FIG. 3 shows a second writing tip 7' having a second shape. The writing tip 7 may be connected to the ink tube 6 in a conventional manner such that ink contained inside the ink tube 6 is permitted to flow into the writing tip 7 and onto a writing surface in a conventional manner.

With continued reference to FIGS. 2-4, the pen 1 includes a cap 28 connected to the shank 2. In embodiments, the shank 2 includes a cavity 30 into which an end 32 of the cap 28 is inserted and held by friction fit. In this manner, the cap 28 is rotatable relative to the shank 2 about the longitudinal axis of the shank 2 when the end 32 of the cap 28 is inserted in the cavity 30 of the shank 2.

In embodiments, the cap 28 includes a longitudinal groove 34 and a circumferential groove 36. The longitudinal groove 34 extends from a central portion of the cap 28 to an end of the cap opposite the end 32. The circumferential groove 36 intersects the longitudinal groove 34. The longitudinal groove 34 and circumferential groove 36 are sized and shaped to receive a writing tip end of the pen as described herein and shown in FIG. 5.

With continued reference to FIGS. 2 and 3, the shank 2 includes first longitudinal grooves 38 at its outer surface. The first guide rail 8 includes arms 40 that extend around the outside surface of the shank 2. Each arm 40 includes a protrusion (e.g., a rib) that extends from the arm 40 inward toward the shank 2. Each of the protrusions is configured to be slidingly engaged in a respective one of the first longitudinal grooves 38. In this manner, with the protrusions in the first longitudinal grooves 38, the first guide rail 8 is held in a connected arrangement on the shank 2 and can translate relative to the shank 2 in a direction along the longitudinal axis of the shank 2.

Figure 5:
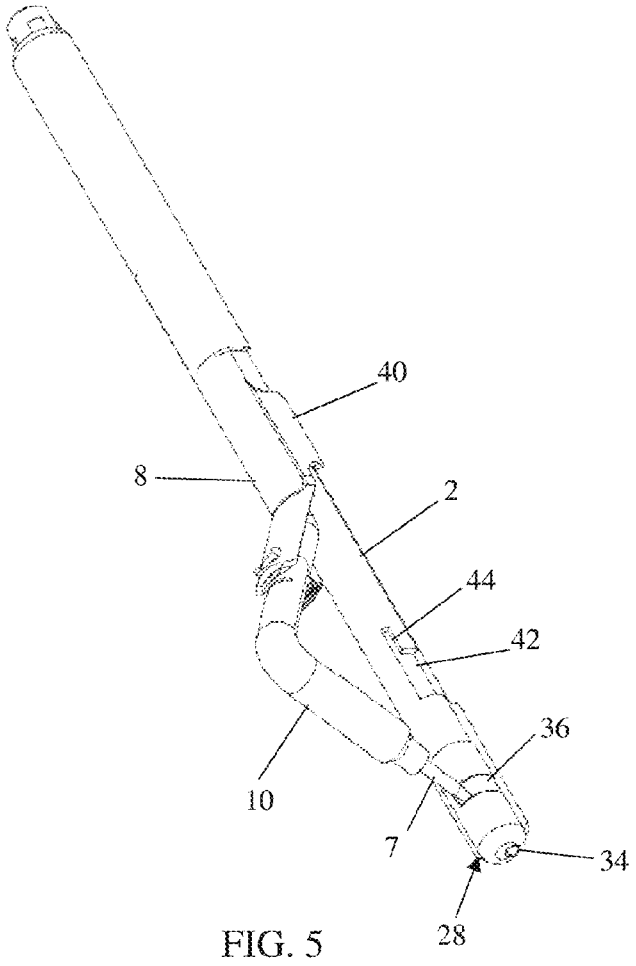
Figure 6:
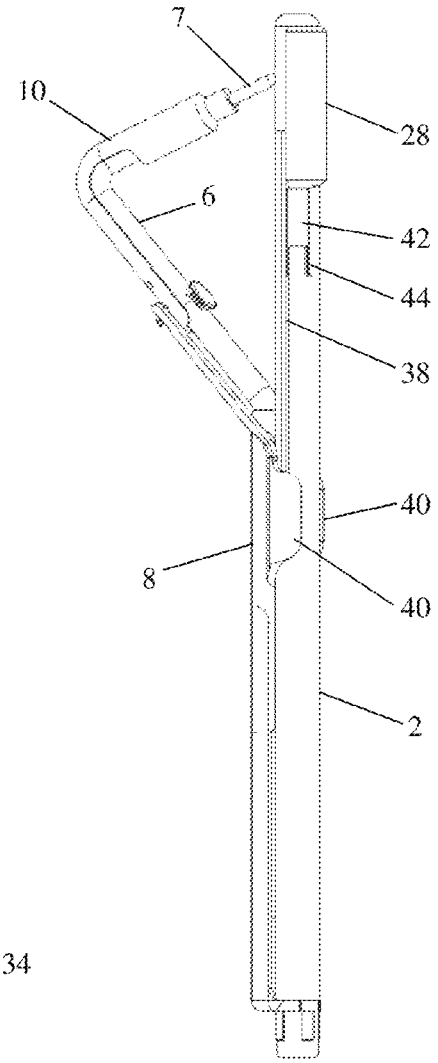
Figure 7A:
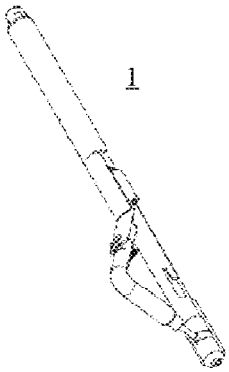
Figure 7B:
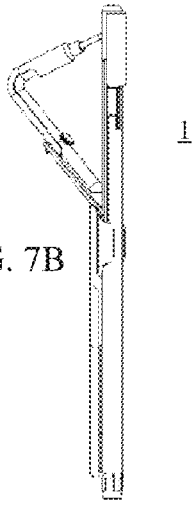
Figure 7C:
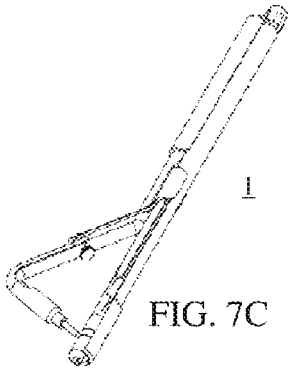
Figure 7G:
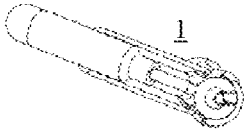
Figure 7D:
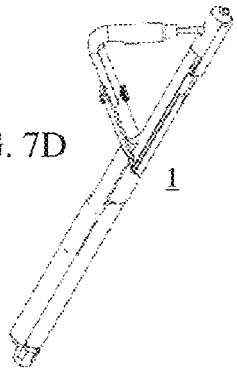
Figure 7E:
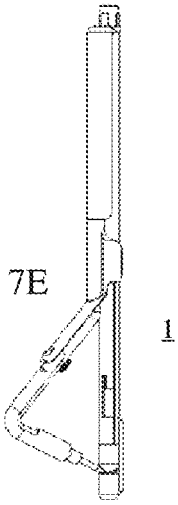
Figure 7F:
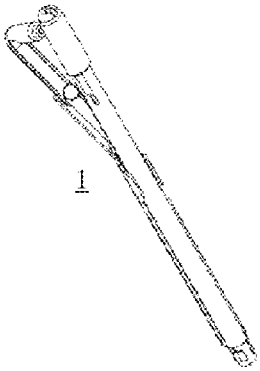

As shown in FIGS. 5 and 6, the shank 2 also includes a respective circumferential groove 42 intersecting each of the first longitudinal grooves 38, and a respective second longitudinal groove 44 intersecting each of the circumferential grooves 42. The circumferential grooves 42 and the second longitudinal grooves 44 are configured to receive the respective protrusions on the insides of the arms 40 of the first guide rail 8, similar to the first longitudinal grooves 38. The circumferential grooves 42 permit rotational movement of the first guide rail 8 relative to the shank 2 about the longitudinal axis of the shank 2. The second longitudinal grooves 44 permit axial translation of the first guide rail 8 relative to the shank 2, e.g., in a manner similar to the first longitudinal grooves 38.

The arrangement of the grooves in the shank 2 (i.e., first longitudinal grooves 38, circumferential groove 42, and second longitudinal grooves 44) and the grooves in the cap 28 (i.e., longitudinal groove 34 and circumferential groove 36) define two positions for the pen 1, i.e., a capped position and a writing position. FIGS. 5 and 6 illustrate the pen 1 in the capped position in which the protrusions on the insides of the arms 40 of the first guide rail 8 are positioned at ends of the first longitudinal grooves 38, and the writing tip 7 is positioned in the circumferential groove 36 in the cap 28. In embodiments, an end portion of the first guide rail 8 is positioned between the cover 4 and the shank 2 in the capped position. FIG. 2 shows the pen 1 in the writing position in which the protrusions on the insides of the arms 40 of the first guide rail 8 are positioned in the second longitudinal grooves 44, and the writing tip 7 is positioned outside the grooves of the cap 28.

Referring to FIGS. 2, 5, and 6, to move the pen from the capped position to the writing position, a first step includes rotating the cap 28 relative to the shank 2 (e.g., counterclockwise in the example depicted in FIG. 5) until the writing tip 7 is at the intersection of the circumferential groove 36 and the longitudinal groove 34 of the cap 28. The first guide rail 8 and the writing tip 7 remain stationary relative to the shank 2 during this rotation of the cap 28.

A second step includes translating the first guide rail 8 relative to the shank 2. The translating is in the direction toward the end of the pen 1 with the cap 28. During this translating, the protrusions on the insides of the arms 40 of the first guide rail 8 slide in the first longitudinal grooves 38 in the shank 2. Also during this translating, the writing tip 7 initially moves through the longitudinal groove 34 of the cap 28 and then exits the longitudinal groove 34 such that the writing tip is outside of the cap 28. The translating of the second step results in the protrusions on the insides of the arms 40 of the first guide rail 8 being positioned at the intersection of the first longitudinal grooves 38 and the circumferential grooves 42 of the shank 2.

A third step includes rotating the first guide rail 8 relative to the shank 2. During this rotation, the protrusions on the insides of the arms 40 of the first guide rail 8 move from the intersection of the first longitudinal grooves 38 and the circumferential grooves 42 of the shank 2 to the intersection of the circumferential grooves 42 and the second longitudinal grooves 44. The writing tip 7 is outside the cap 28 and rotates with the first guide rail 8 relative to the shank 2.

A fourth step includes translating the first guide rail 8 relative to the shank 2. The translating of the fourth step is in the direction away from the end of the pen 1 with the cap 28, e.g., in a direction opposite the translating of the second step. During the translating of the fourth step, the protrusions on the insides of the arms 40 of the first guide rail 8 slide in the second longitudinal grooves 44 in the shank 2 to the ends of these grooves 44. The writing tip 7 is outside the cap 28 and translates with the first guide rail 8 relative to the shank 2. The steps may be performed in the reverse order to manipulate the pen 1 from the writing position to the capped position.

Figure 8A:
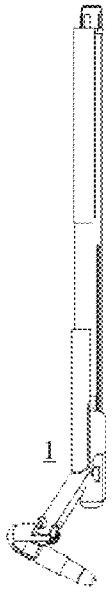
Figure 8B:
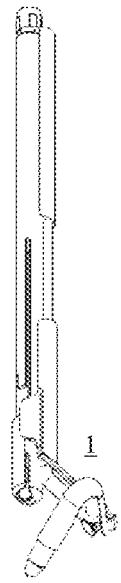
Figure 8C:
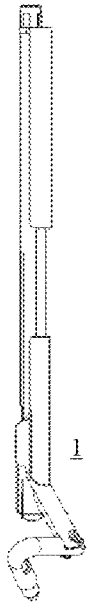
Figure 8D:
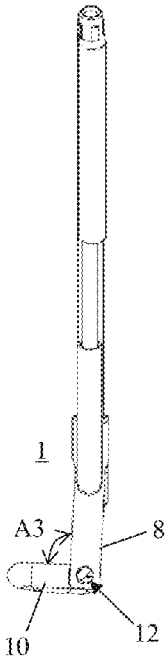
Figure 8E:
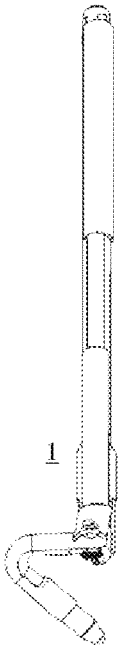
Figure 8F:
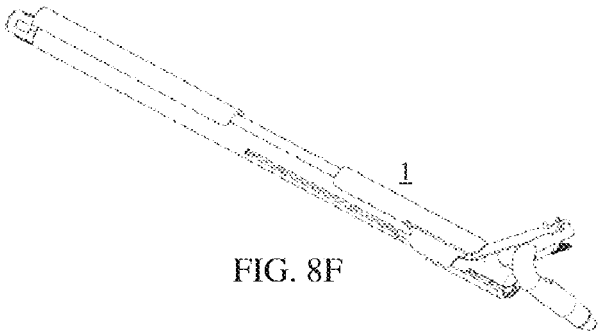
Figure 8G:
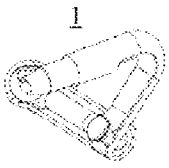

After the pen 1 is arranged into the writing position, the second guide rail 10 may be rotated relative to the first guide rail 8 in the manner already described herein. For example, the second guide rail 10 may be rotated by any desired angle between 1° and 90° relative to the first guide rail 8. Rotating the second guide rail 10 relative to the first guide rail 8 bends the ink tube 6 at an angle A3 between sections 6*b* and 6*c* (A3 is shown in FIG. 8D), and moves the writing tip 7 relative to the shank 2. In this manner, the user may manipulate the position of the writing tip 7 relative to the shank 2 to adjust the pen 1 to a desired writing angle. In a preferred embodiment, the pen 1 is structured and arranged such that the terminal end of the writing tip 7 is positioned on or very close to (e.g., within 1 to 2 mils of) the longitudinal axis of the shank 2 when the pen 1 is in the writing position and at all angles of rotation of the second guide rail 10 relative to the first guide rail 8. In this manner, a user holding the pen 1 in their left hand may position the writing tip 7 relative to the writing surface in the half cone described with respect to FIG. 1. As such, implementations of the pen 1 permit a left handed user to drag the writing tip 7 across the writing surface when writing from left (positioning the tip for the preferred drag direction) to right with the pen in their left hand, as opposed to pushing the writing tip into the paper as is the case when writing in the same manner using a conventional pen. The same pen can be used to achieve a dragging motion (instead of a pushing motion) for a right handed person holding the pen in their right hand and moving the pen in a right to left direction across the page.

FIGS. 7A-G show different views of the pen 1 with the writing tip 7 in the capped position. FIGS. 8A-G show different views of the pen 1 with the writing tip 7' in the writing position. Specifically, FIG. 8D best illustrates the third angle A3 between the second section 6*b* and third section 6*c* of the ink tube 6 when the second guide rail 10 is pivoted relative to the first guide rail 8 at the pivot 12. The components of the pen 1 may be made of suitable materials, including but not limited plastic and/or metal. In a preferred embodiment, the ink tube 6 is composed of a plastic having sufficient flexibility and resiliency to permit the bending described herein without permanently damaging (e.g., kinking) the ink tube 6.

Figure 9:
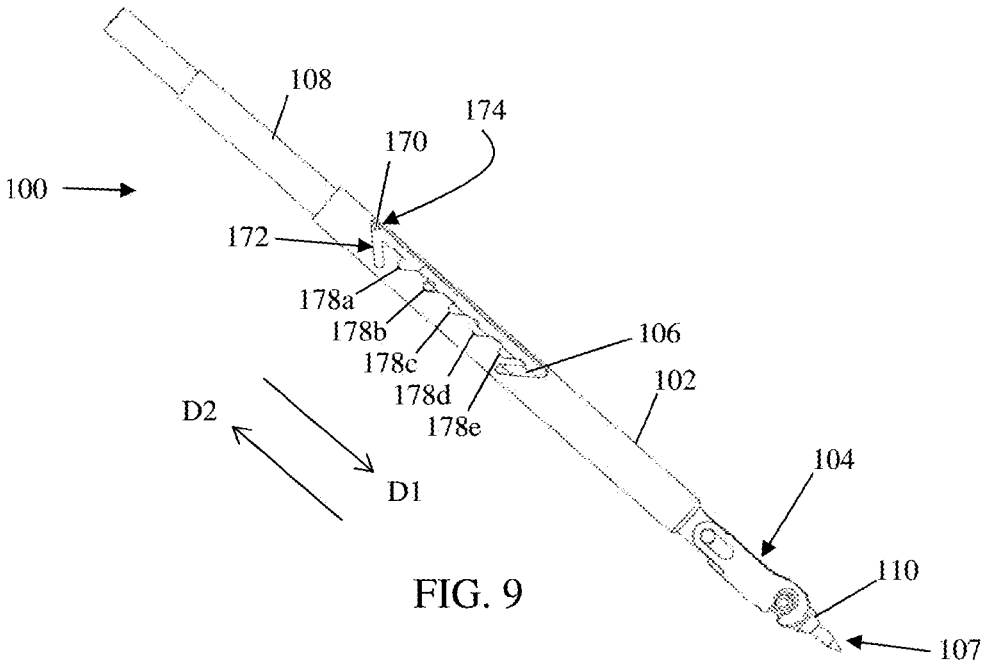
Figure 10:
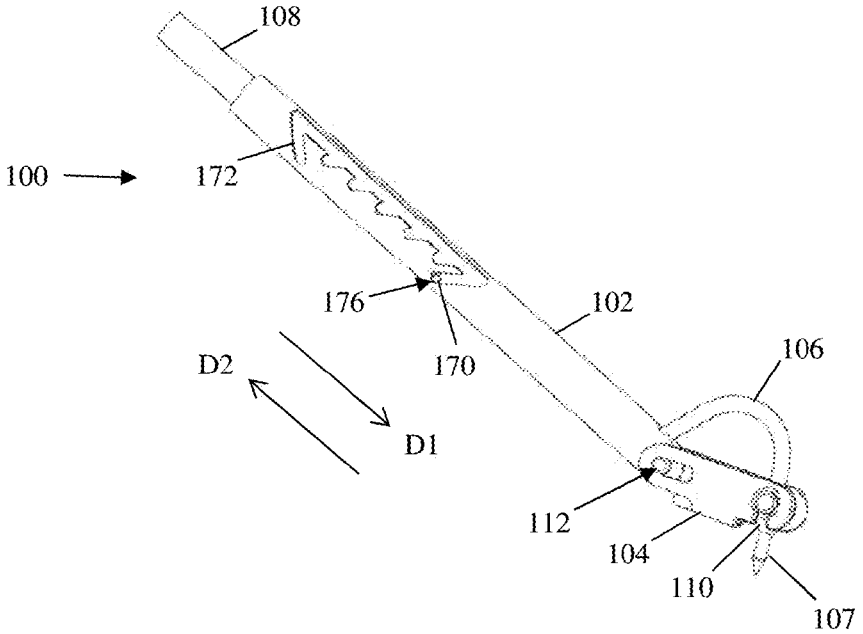

FIGS. 9-11 show another embodiment of a pen 100 in accordance with aspects of the invention. FIG. 9 shows the pen 100 in a first (straight) position, and FIG. 10 shows the pen 100 in a second (non-straight) position. FIG. 11 shows an exploded view of the pen 100. In embodiments, the pen 100 includes a shank 102, chassis 104, ink tube 106, writing tip 107, and push element 108. The ink tube 106 is a tubular member with an internal cavity that is used to store ink for delivering to the writing tip 107. In a preferred embodiment, the ink tube 106 is composed of a plastic having sufficient flexibility and resiliency to permit the bending described herein without permanently damaging (e.g., kinking) the ink tube 106. The writing tip 107 may be any suitable type of writing tip, including but not limited to a ball point tip, felt tip, etc. The writing tip 107 may be connected to the ink tube 106 in a conventional manner such that ink contained inside the ink tube 106 is permitted to flow into the writing tip 107 and onto a writing surface in a conventional manner.

According to aspects of the invention, the chassis 104 is pivotally connected to the shank 102, a first (proximal) end of the ink tube 106 is connected to the push element 108 inside the shank 102, and a second (distal) end of the ink tube 106 is connected to the writing tip 107 at the chassis 104. The push element 108 is slidably received inside the shank 102 and can translate relative to the shank 102 along a longitudinal axis of the shank 102. In aspects, at least one of the ink tube 106 and the writing tip 107 passes through a gimbal 110 that is pivotally connected to the chassis 104. Due to the proximal end of the ink tube 106 being connected to the push element 108, the ink tube 106 is urged to move in the direction "D1" when the push element 108 is depressed into the shank 102. Due to the distal end of the ink tube 106 being constrained at the gimbal 110, when the ink tube moves in the direction "D1", a portion of the ink tube 106 moves out of the end of the shank 102 and flexes into a bent shape. The bending of the ink tube 106 causes the chassis 104 to rotate relative to the shank 102 at a pivot 112. The bending of the ink tube 106 also causes the gimbal 110 to rotate relative to the chassis 104. In this manner, the longitudinal axis of the writing tip 107 may be selectively rotated relative to the longitudinal axis of the shank 102.

FIG. 12 shows a bottom view of the pen 100. FIG. 13 shows a cross-section view of the pen 100 taken along line XIII-XIII of FIG. 12 and looking in the direction of arrows "A". With reference to FIGS. 11-13, in embodiments the chassis 104 includes two proximal arms 120 and two distal arms 122 connected to a central portion 124. In aspects, each of the distal arms 122 includes a structure that provides a rotational connection between the chassis 104 and the gimbal 110. For example, each of the distal arms 122 may include a circular slot 130 that is sized to receive a pin 132 of the gimbal 110. Each of the distal arms 122 may also include a slot 134 that is smaller than both the diameter of the circular slot 130 and the diameter of the pin 132. In embodiments, the chassis 104 is composed of a resilient material such that the distal arms 122 may be flexed to increase the size of the slots 134 to permit the pins 132 to pass through the slots 134 and into the circular slots 130, with the distal arms 122 resiliently returning to their original shape when the pins are seated in the circular slots 130. In this manner, the gimbal 110 may be snap-fit into the chassis 104 and permitted to rotate relative to the chassis 104 while being held in the circular slots 130.

In one embodiment, at least one of the ink tube 106 and the writing tip 107 is friction fit inside the gimbal 110. In an alternative embodiment, the ink tube 106 and writing tip 107 are free-moving through the hole in the gimbal 110, whereby the flexibility of the bent ink tube 106 and the translational degree of freedom of the ink tube 106 and the writing tip 107 relative to the gimbal 110 provides a dynamic shock absorber at the writing end of the pen 100.

Still referring to FIGS. 11-13, in aspects each of the proximal arms 120 includes a structure that provides a rotational and translational connection between the chassis 104 and the shank 102. In embodiments, each of the proximal arms 120 includes an elongate channel 138, with each of the elongate channels 138 being sized to receive a respective protrusion 140 on the shank 102. Each channel 138 may be rounded at each end with a diameter slightly larger than the diameter of the protrusions 140. Each channel 138 may also have a length that is substantially greater than (e.g., at least 2 times) the diameter of the protrusions 140. In this manner, when the respective protrusions 140 are positioned inside the respective channels 138, the protrusions 140 define a pivot axis of rotation for the chassis 104 relative to the shank 102. Moreover, when the respective protrusions 140 are positioned inside the respective channels 138, the channels 138 permit translation of the chassis 104 relative to the shank 102. In embodiments, the chassis 104 is composed of a resilient material that permits the proximal arms 120 to be flexed to increase the size of a gap between the proximal arms such that the protrusions 140 may be inserted into the channels 138, with the proximal arms 120 resiliently returning to their original shape when channels 138 contain the protrusions 140. In this manner, the chassis 104 may be snap-fit onto the shank 102.

With specific reference to FIG. 12, in embodiments the shank 102 includes a groove 142 and the chassis 104 includes a rib 144 configured to fit within the groove 142. Specifically, when the pen 100 is in the straight position depicted in FIG. 9, the chassis 104 is positioned relative to the shank 102 such that the rib 144 is inside the groove 142.

With specific reference to FIG. 13, in embodiments the shank 102 includes an interior 146 in which the ink tube 106 is positioned, and an opening 148 through which the ink tube 106 extends out of the shank 102. In aspects, the opening 148 has a smaller inside diameter than that of the interior 146. The opening 148 thus keeps the ink tube 106 substantially centered on the longitudinal axis of the shank 102.

As shown in FIGS. 11 and 13, the pen 100 may include a spring 150 operatively connected between the push element 108 and the ink tube 106. In embodiments, the spring 150 is a compression coil spring with a first end connected to the push element 108 and a second end connected to the ink tube 106. In a preferred embodiment, the proximal end of the ink tube 106 is positioned in a central hole 152 in the end of the push element 108, and the first end of the spring 150 is positioned in an offset hole 154 in the same end of the push element 108. In this preferred embodiment, the spring 150 coils around a portion of the ink tube 106, and the second end of the spring 150 is connected to a stop element 156 affixed on the ink tube 106.

Figure 14:
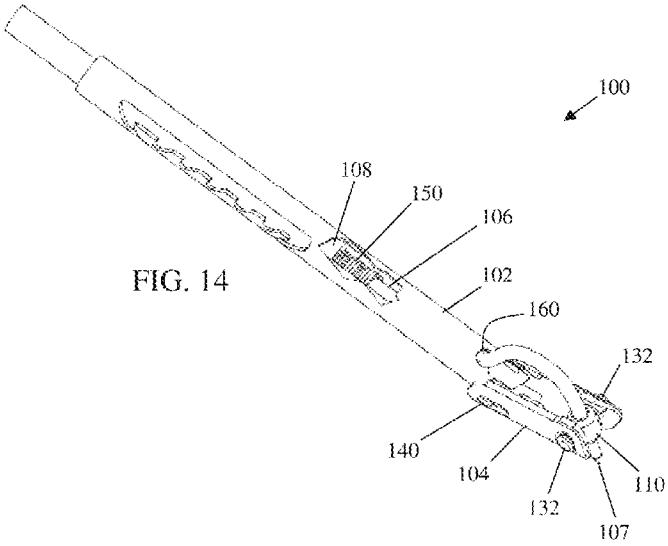

FIG. 14 shows a perspective view of the assembled pen 100 with a portion of the shank 102 being cut away to show the spring 150, ink tube 106, and push element 108 positioned inside the shank 102. According to aspects of the invention, a semi-circular channel 160 is provided at a top portion of the shank 102 at the end of the shank 102 where the ink tube 106 extends out of the shank 102. The channel 160 is sized to accommodate the ink tube 106 when the ink tube 106 bends when the chassis 104 rotates relative to the shank 102 about the axis defined by the protrusions 140.

Figure 15:
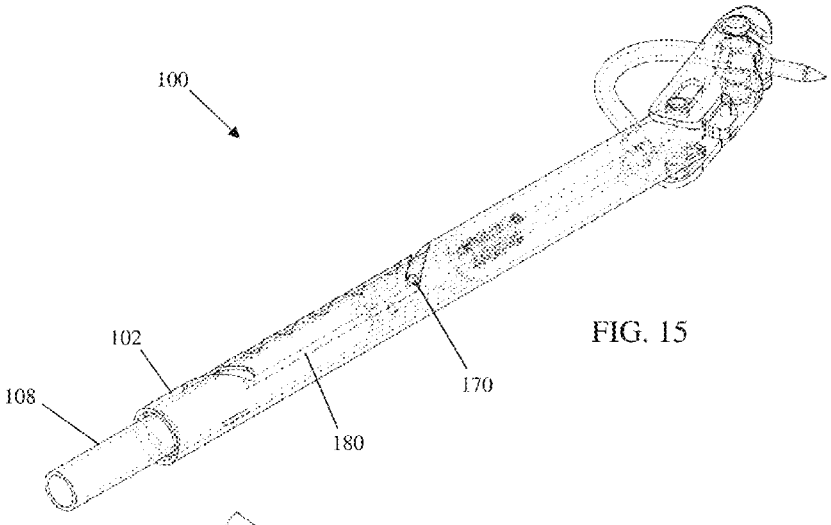

Referring now to FIGS. 9-11, in embodiments a follower 170 is on the push element 108, and the shank 102 includes a slot 172 that defines plural positions for the follower 170. The follower 170 may comprise, for example, a protrusion on a surface of the push element 108. FIG. 9 shows the follower 170 at a first position 174 in the slot 172 corresponding to a least amount of bend of the ink tube 106 (e.g., no bend). FIG. 10 shows the follower 170 at a last position 176 in the slot 172 corresponding to a greatest amount of bend of the ink tube 106. In embodiments, the slot 172 also includes at least one intermediate position, for example and without limitation five intermediate positions 178*a-e* shown in FIGS. 9 and 10. Notches in the slot 172 may be used to define the intermediate positions 178*a-e*. According to aspects of the invention, the follower 170 extends outward from the surface of the push element 108 and into a cavity defied by the slot 172. The positions 174, 176, 178*a-e* correspond to locations where the follower 170 abuts against one or more interior sidewalls of the slot 172 in a manner such that the follower 170 and the connected push element 108 and ink tube 106 are prevented from traveling in the direction D1 when the follower 170 is located at one of the positions 174, 176, 178*a-e*. When the follower 170 is at any of the positions 174 and 178*a-e* other than the last position 176 and the user presses the push element 108 in the direction D1, the follower 170 moves from its current position (e.g., position 174) to the next position (e.g., position 178*a*). When the follower 170 is at the last position 176 and the user presses the push element 108 in the direction D1, the follower 170 moves from the last position 176 to the first position 174 along a groove 180 (shown in FIG. 15) on an interior surface of the shank 102.

The pen 100 functions as follows. When the push element 108 is pressed against the internal spring 150 located inside the tubular shank 102 around the ink tube 106 and working between the tubular shank 102 and the push element 108, the flexible ink tube 106 will start to slide forward and bend at two points: first at the point of exit of the tubular shank 102 then make a wide parabolic bend towards the gimbal 110. The gimbal 110 through which the ink tube 106 passes turns the conical writing tip 107 of the pen downward and toward the left. With every press of the push element 108, the hinged arms of the chassis 104 on both sides of the gimbal 110 aid in repositioning the writing tip 107 by bending forward with the action of the ink tube 106, which will behave like a spring. The whole assembly will behave like a shock absorber while the pen 100 is in use. If the writer decides to reposition the tip of the pen, all he/she has to do is press the push element 108 and the follower 170 in the slot 172 on the side of the tubular shank 102 behaves with a cam action to rotate downwards then reverse rotate back up to lock each at one of the position 174, 176, 178*a-e* of the notch on the shank 102 with the help of the internal spring 150. Then the last position of the slot 172 has an internal groove 180 on the shank 102 that will let the follower 170 ride all the way back up to the top, e.g., the first position 174, allowing the whole assembly to become straight as shown in FIG. 9, retracting the writing tip 107 of the pen in towards the shank 102. In the straight (e.g., closed) position, the writing tip 107 of the pen is contained inside the two arms of the chassis 104 and the pen 100 is straight like a conventional pen.

According to aspects of the invention, each one of the positions 174, 176, 178*a-e* corresponds to a different predefined angular position of the chassis 104 (and, thus, also the writing tip 107) relative to the shank 102. In this manner, a user of the pen 100 may change the angle of the writing tip 107 relative to the shank 102 by pressing the push element 108 into the shank 102 in the manner described herein.

Figure 16:
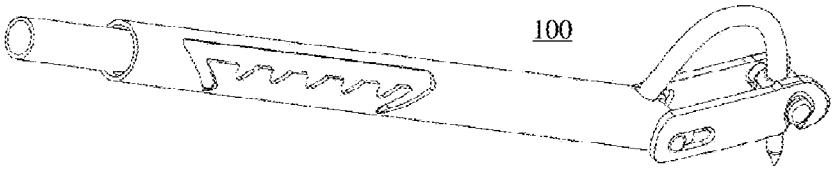
Figure 17:
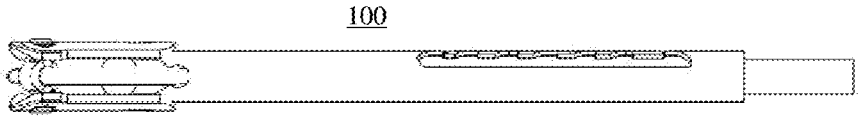
Figure 18:
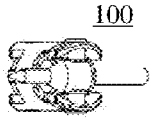
Figure 19A:
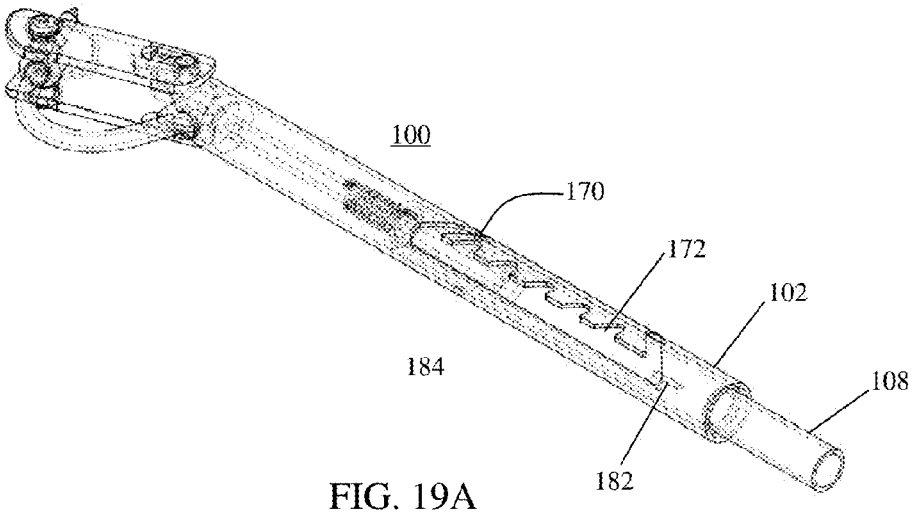
Figure 19B:
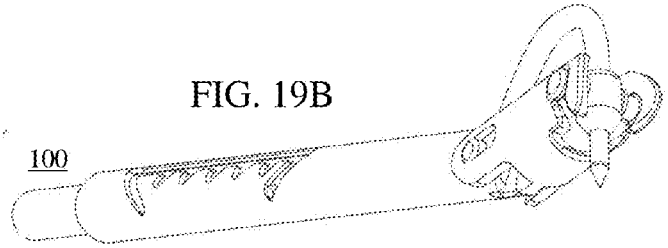
Figure 19C:
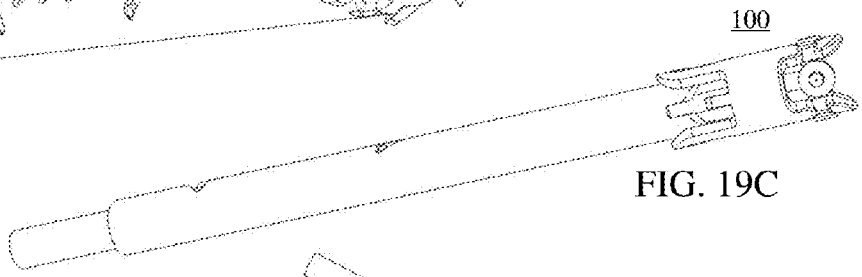
Figure 19D:
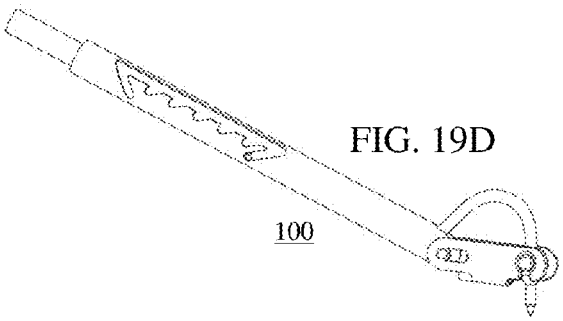
Figure 19E:
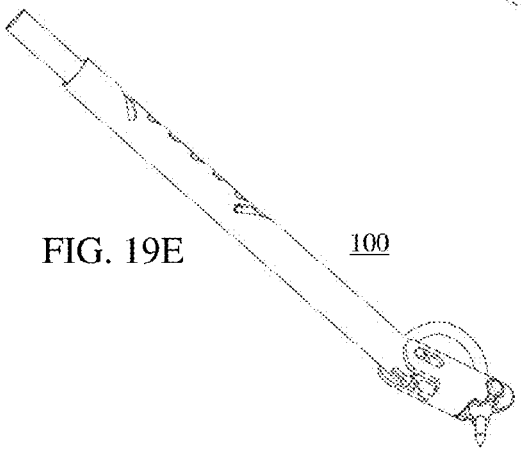
Figure 19F:
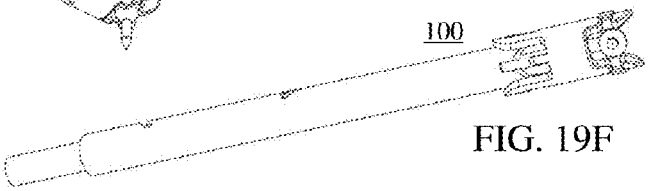
Figure 19G:
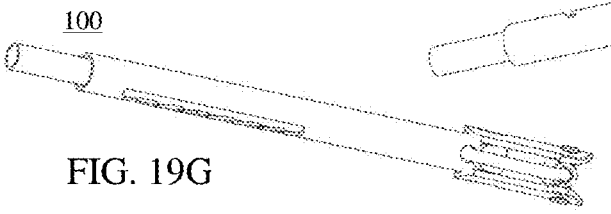
Figure 19H:
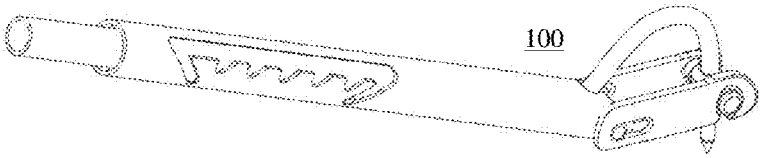
Figure 20:
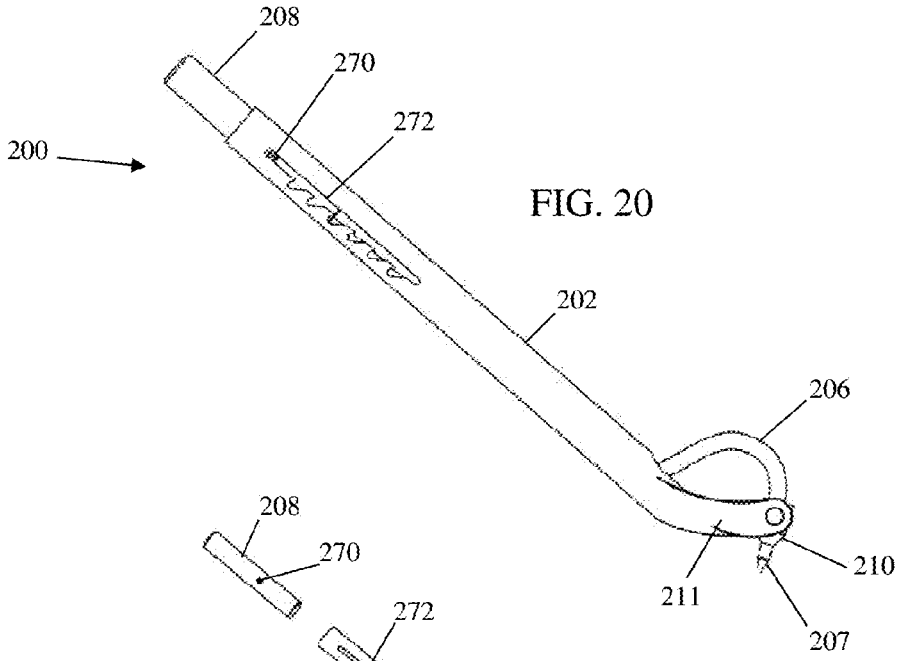
FIGS. 20-25 show another pen in accordance with aspects of the invention.
Figure 21:
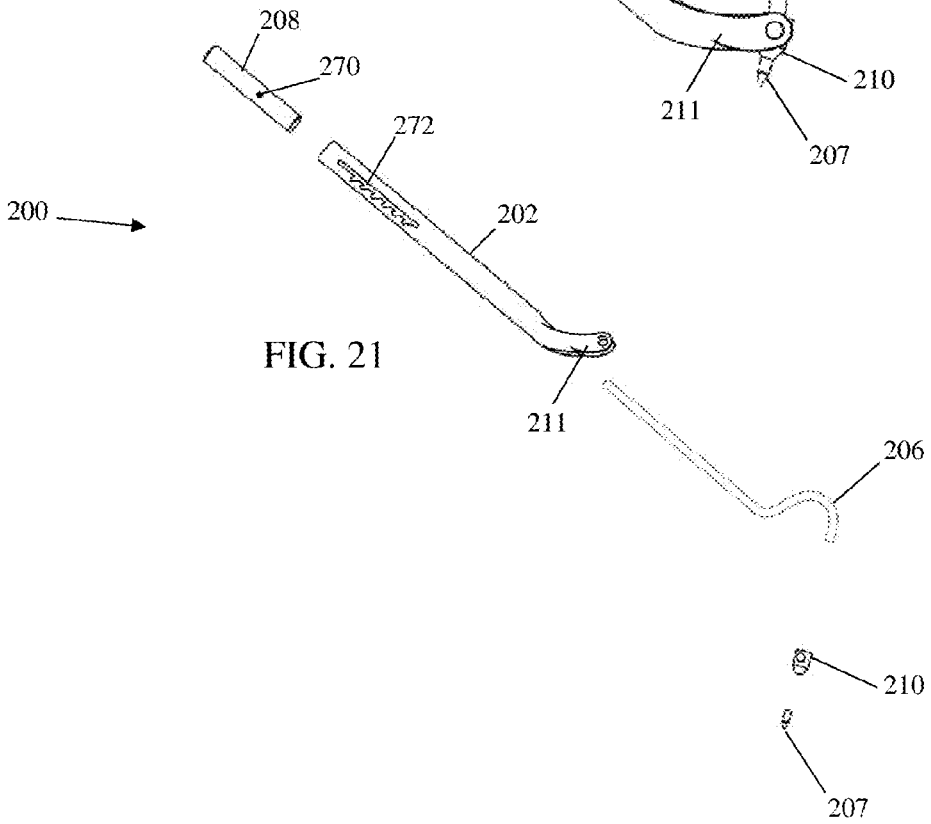
Figure 22:
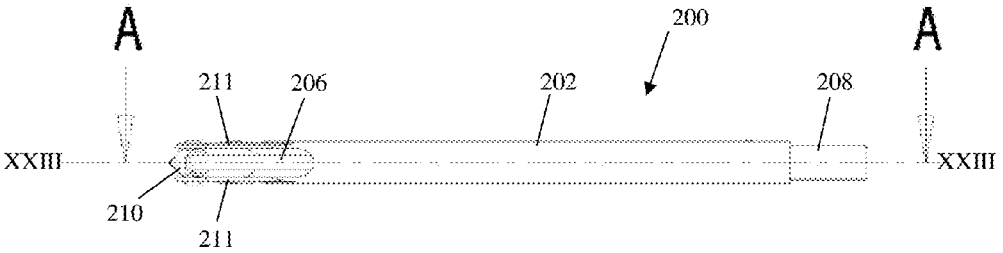
Figure 23:
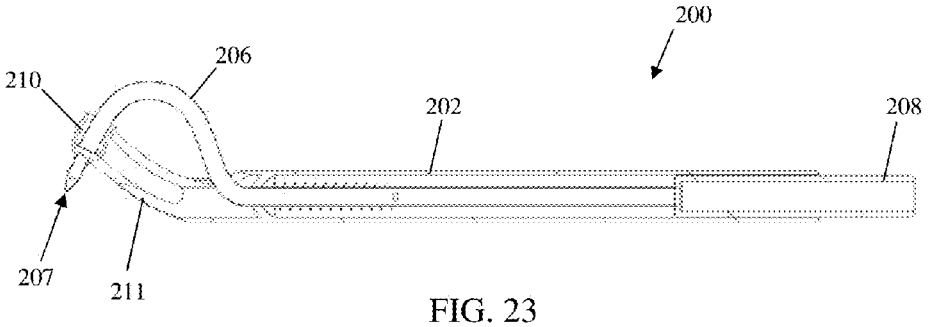
Figure 24:
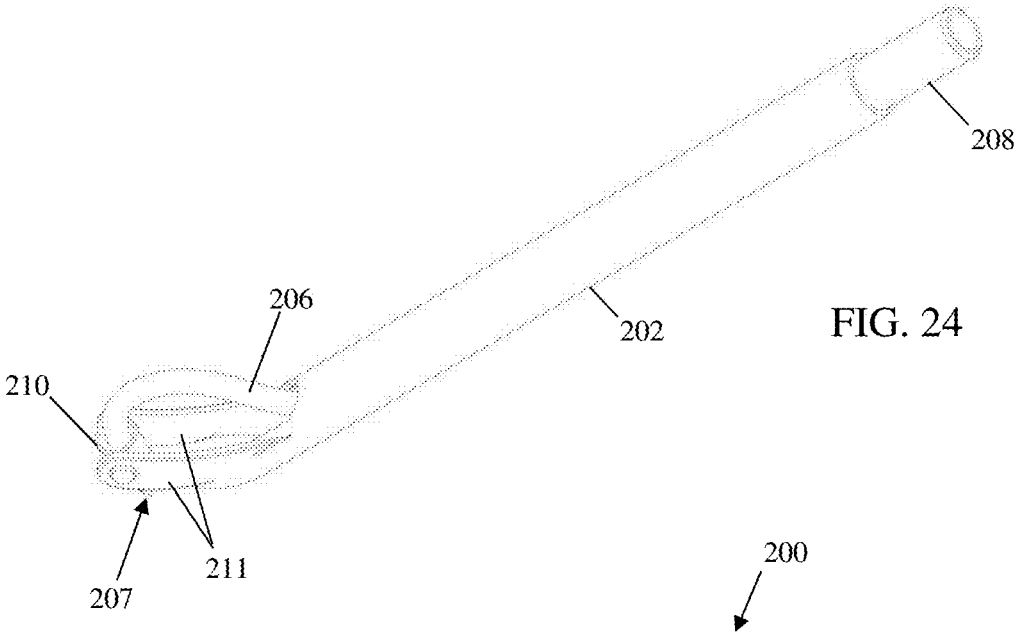
Figure 25:
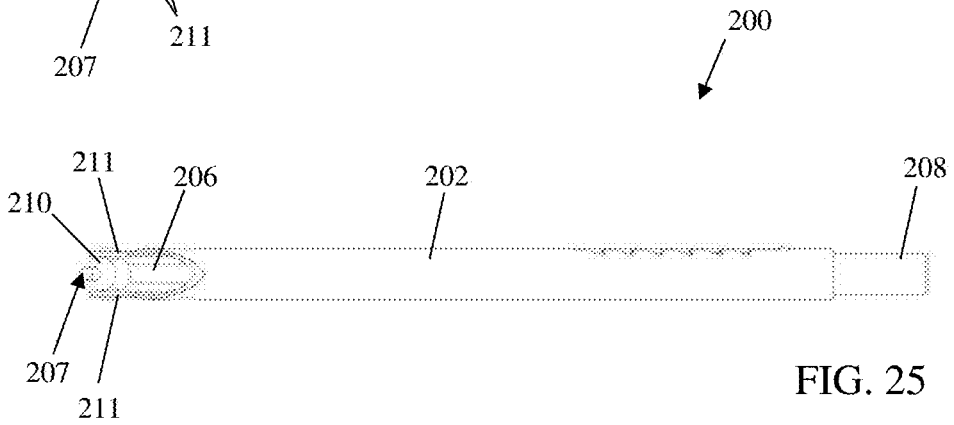

FIGS. 16-18 and 19A-H show additional views of the pen 100 and illustrate various aspects described herein. FIG. 16 shows a perspective view of the pen 100. FIG. 17 shows a top view of the pen 100. FIG. 18 shows an end view of the pen 100. FIG. 19A shows internal details of the pen 100 in dashed lines. In embodiments, and as illustrated in FIG. 19A, a rib 182 may be provided on an interior wall of the shank 102 generally opposite the slot 172. The rib 182 guides a button 184 on the push element 108 to force the follower 170 in the correct desired direction in the slot 172. FIGS. 19B-H show additional view of the pen 100.

FIGS. 20-25 show another embodiment of a pen 200 in accordance with aspects of the invention. In embodiments, the pen 200 includes a shank 202, ink tube 206, writing tip 207, and push element 208. The ink tube 206 is a tubular member with an internal cavity that is used to store ink for delivering to the writing tip 207. In a preferred embodiment, the ink tube 206 is composed of a plastic having sufficient flexibility and resiliency to permit the bending described herein without permanently damaging (e.g., kinking) the ink tube 206. The writing tip 207 may be any suitable type of writing tip, including but not limited to a ball point tip, felt tip, etc. The writing tip 207 may be connected to the ink tube 206 in a conventional manner such that ink contained inside the ink tube 206 is permitted to flow into the writing tip 207 and onto a writing surface in a conventional manner.

In embodiments, the pen 200 includes a push button manipulation mechanism similar to pen 100. For example, pen 200 includes a slot 272 in the shank 202 and a follower 270 on the push element 208, and these elements function in a manner similar to the slot 172 and follower 170 of pen 100. Pen 200 also includes a gimbal 210 that functions in a manner similar to the gimbal 110 of pen 100. Pen 200 differs from pen 100 at least in that pen 200 does not include a chassis that is rotatably connected to the shank 202. Instead, in pen 200 the shank 202 includes fixed arms 211 that extend away from an opening where the ink tube 206 exits the interior cavity of the shank 202. A proximal end of each arm 211 is connected to the tubular body of the shank 202, and a distal end of each arm 211 provides a pivotal connection point for the gimbal 210.

In operation of the pen 200, when a user depresses the push element 208 into the shank 202, the follower 270 is moved to a next position in the slot 272, e.g., similar to the operation of pen 100. Each pre-defined position in the slot 272 corresponds to a differing amount of bend of the ink tube 206 extending out of the end of the shank 202, which in turn corresponds to a different rotational angle of the gimbal 210 relative to the arms 211. In this manner, a user of the pen 200 may change the angle of the writing tip 207 relative to the shank 202 by pressing the push element 208 in to the shank 202.

Each of the pens (1, 100, 200) described herein permit a user to selectively adjust an angular position of the writing tip relative to the shank, such that the user holding the pen (1, 100, 200) in their left hand may position the writing tip relative to the writing surface in the half cone described with respect to FIG. 1. As such, implementations of the pen (1, 100, 200) permit a left handed user to drag the writing tip across the writing surface when writing from left to write with the pen in their left hand, as opposed to pushing the writing tip into the paper as is the case when writing in the same manner using a conventional pen.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A pen, comprising:
a shank;
a push element slidably connected to the shank;
a chassis pivotally connected to the shank;
a gimbal pivotally connected to the chassis; and
an ink tube having a first end connected to the push element and a second end connected to a writing tip, wherein at least one of the ink tube and the writing tip passes through the gimbal.

2. The pen of claim 1, wherein moving the push element in a first direction relative to the shank changes an angle of the writing tip relative to a longitudinal axis of the shank.

3. The pen of claim 2, wherein:
the shank includes a slot;
the push element comprises a follower configured to be selectively positioned at one of a plurality of positions in the slot; and
each of the plurality of positions corresponds to a different value of the angle of the writing tip relative to a longitudinal axis of the shank.

4. The pen of claim 3, the plurality of positions include:
a first position corresponding to a lowest value of the angle of the writing tip relative to a longitudinal axis of the shank;
a last position corresponding to a highest value of the angle of the writing tip relative to a longitudinal axis of the shank; and
at least one intermediate position between the first position and the last position.

5. The pen of claim 4, wherein the shank comprises an interior groove that directs the follower from the last position to the first position.

6. The pen of claim 4, wherein:
at the first position the ink tube is straight;
at the second position the ink tube is bent.

7. The pen of claim 1, wherein:
the first end of the ink tube is in a hole in a distal end of the push element;
a spring is connected to the distal end of the push element and to a stop element at an intermediate location of the ink tube.

8. The pen of claim 1, wherein:
the chassis is rotatable and translatable relative to the shank;
the shank comprises a groove; and
the chassis comprises a rib that is moveable into and out of the groove.

9. A pen, comprising:
a shank;
a push element slidably connected to the shank; and
an ink tube having a first end connected to the push element and a second end connected to a writing tip,
wherein at least one of the ink tube and the writing tip passes through a pivotable gimbal; and
the ink tube is bent at a location that is both between the first end and the second end and outside the shank.

10. The pen of claim 9, wherein the gimbal is pivotally connected to a chassis that is pivotally connected to the shank.

11. The pen of claim 9, wherein the gimbal is pivotally connected to arms extending from an end of the shank.

12. The pen of claim 9, wherein moving the push element in a first direction relative to the shank changes an angle of the writing tip relative to a longitudinal axis of the shank.

* * * * *